US009486895B2

(12) United States Patent
Mueller

(10) Patent No.: US 9,486,895 B2
(45) Date of Patent: Nov. 8, 2016

(54) METHOD AND GRINDING TOOL FOR HIGHLY ACCURATE CENTRE-LESS GRINDING OF SHAFT PARTS WITH HIGH SURFACE QUALITY

(71) Applicant: ERWIN JUNKER GRINDING TECHNOLOGY A.S., Melnik (CZ)
(72) Inventor: Hubert Mueller, Nordrach (DE)
(73) Assignee: ERWIN JUNKER GRINDING TECHNOLOGY A.S., Melnik (CZ)

( * ) Notice: Subject to any disclaimer, the term of this patent is extended or adjusted under 35 U.S.C. 154(b) by 0 days.
(21) Appl. No.: 14/764,428
(22) PCT Filed: Feb. 10, 2014
(86) PCT No.: PCT/EP2014/052567
§ 371 (c)(1),
(2) Date: Jul. 29, 2015
(87) PCT Pub. No.: WO2014/124907
PCT Pub. Date: Aug. 21, 2014
(65) Prior Publication Data
US 2015/0360347 A1 Dec. 17, 2015
(30) Foreign Application Priority Data
Feb. 15, 2013 (DE) ..... 10 2013 202 509
(51) Int. Cl.
*B24B 5/22* (2006.01)
*B24D 5/14* (2006.01)
(Continued)
(52) U.S. Cl.
CPC . *B24D 5/14* (2013.01); *B24B 5/22* (2013.01); *B24D 5/02* (2013.01); *B24D 5/066* (2013.01)
(58) Field of Classification Search
CPC ..... B24B 5/22; B24D 5/14; B24D 5/02; B24D 5/066
USPC ..... 451/43, 58, 59, 65, 242
See application file for complete search history.

(56) References Cited
U.S. PATENT DOCUMENTS
1,647,129 A * 11/1927 Heim ..... B24B 5/22 451/245
2,144,987 A * 1/1939 Miller ..... B24B 3/602 451/48
(Continued)
FOREIGN PATENT DOCUMENTS
DE 2462847 C2 5/1986
DE 8904986 U1 6/1989
(Continued)
OTHER PUBLICATIONS
International Search Report for Application No. PCT/EP2014/052567, dated Jun. 20, 2014.
(Continued)

*Primary Examiner* — George Nguyen
(74) *Attorney, Agent, or Firm* — Marshall, Gerstein & Borun LLP

(57) ABSTRACT

Disclosed is a grinding tool (1) for highly accurate centre-less grinding in continuous process for shaft-like workpieces (16), comprising at least one conical (3) and one cylindrical grinding region (4). With its first grinding cover (13), the conical grinding region (3) is primarily intended for grinding larger cutting volumes, whereas the cylindrical grinding region (4), with its second grinding cover (14) is primarily intended for achieving the highest surface quality, without, in the case of the latter, having to remove large cutting volumes. The grinding covers (13, 14) differ at least in respect of the grinding agent used, CBN preferably being used in the conical region and diamond being used in the cylindrical region. Further disclosed is a method, which works with the grinding tool (1) as per the invention and which grinds the shaft-like workpieces (16). Oversize and surface quality are at least temporarily simultaneously ground.

11 Claims, 6 Drawing Sheets

(51) Int. Cl.
*B24D 5/02* (2006.01)
*B24D 5/06* (2006.01)

(56) References Cited

U.S. PATENT DOCUMENTS 2,224,423 A * 12/1940 Binns ..... B24B 5/18 451/242
3,534,507 A * 10/1970 Barhorst ..... B24B 5/18 451/242
3,537,216 A * 11/1970 Borgh ..... B24B 1/00 451/58
3,718,938 A * 3/1973 Blume ..... A01K 97/00 403/106
4,083,151 A * 4/1978 Jessup ..... B24B 5/01 451/242
5,410,843 A * 5/1995 Gottschald ..... B24B 55/02 451/43
5,542,876 A * 8/1996 Field, Jr. ..... B24D 5/14 451/255
5,643,052 A * 7/1997 Delattre ..... B23Q 41/00 451/21
2002/0115391 A1* 8/2002 Yamaguchi ..... B24B 5/24 451/49
2005/0026553 A1* 2/2005 Bonner ..... B24B 5/18 451/49

FOREIGN PATENT DOCUMENTS

DE 68919908 T2 5/1995
DE 19920189 A1 11/2000
EP 0186101 A1 7/1986
EP 1285726 A2 2/2003
GB 1489968 10/1977
JP S6279954 A 4/1987

OTHER PUBLICATIONS

German Search Report for Application No. 102013202509.2, dated Dec. 10, 2013.

* cited by examiner

METHOD AND GRINDING TOOL FOR HIGHLY ACCURATE CENTRE-LESS GRINDING OF SHAFT PARTS WITH HIGH SURFACE QUALITY

CROSS-REFERENCE TO RELATED APPLICATIONS

This is the United States national phase of International Patent Application No. PCT/EP2014/052567, filed Feb. 10, 2014, which claims the priority benefit of German Application No. 10 2013 202 509.2, filed Feb. 15, 2013. The entire contents of each of the foregoing is hereby incorporated herein by reference.

FIELD OF THE DISCLOSURE

The invention relates to a method and a grinding tool for high-precision centerless grinding of shaft-like workpieces with a high surface quality, such as in particular piston pins, shock absorber parts and piston rods for hydraulic or pneumatic cylinders.

BACKGROUND

Within the scope of this invention, high-precision ground shaft parts with a high surface quality are understood to be shaft-like parts whose surface quality and roundness tolerance amount to approximately 1 μm or less. Very high demands are made of the shape tolerance and surface quality for piston pins, shock absorber parts and piston rods for pressure cylinders in particular, these demands arising from the requirement for extremely reliable operation during use. Thus, for example, in the case of shaft-like shock absorber parts, sealing elements that slide on the surfaces of these shock absorber parts and must ensure a reliable seal from the inside to the outside as well as from the outside to the inside are provided on the shock absorbers. For piston pins, these high quality demands are derived from, among other things, the fact that the operating properties are exacerbated when the surface quality and the shape tolerances are lower than those given above.

It is known that the required surface quality and shape tolerance cannot be produced by grinding using known grinding wheels, which should also yield a reasonable cutting performance in addition to the high surface quality. Despite the fact that many such shaft parts are needed in large quantities, are to be manufactured inexpensively and with the shortest possible cycle time, a compromise is made between a high material removal performance and a high surface quality using known methods and machinery. This is because the required high material removal performance is achieved in a very good quality using traditional grinding machines, but the required high surface quality is achieved on an additional machine in a superfinishing process downstream from the grinding machine. Even if a combined machine, which performs the grinding in a first station and the superfinishing process in a second station, were conceivable, there would still be the major disadvantage that the workpieces must pass through at least two machining stations and thus there is a loss of manufacturing precision due to the re-chucking alone. In manufacturing on two different manufacturing machines, a) a greater space requirement is necessary, b) the costs are additionally much higher, and c) the corresponding handling systems are additionally needed between the two machines.

As a rule, a buffer storage must also be provided between the individual operating sequences, thus further increasing the cost of manufacturing.

To nevertheless be able to achieve the manufacturing costs and a short and simple flow of materials in production of the workpieces, it is known to be necessary to minimize the number of manufacturing steps. A relatively inexpensive production of the shaft-like workpieces with satisfactory accuracy, at least for a number of applications, can be achieved on surface quality and shape tolerance with the known machines and production processes. In particular, this has been possible through centerless grinding. In centerless grinding, the shaft-like components are often machined in a continuous process. However, it is impossible to achieve accuracy ranges even lower than 1 μm, as given above.

The fundamental design of such a centerless grinding machine is illustrated in a side view in FIG. 4 as an example. The workpiece to be ground rests on a support, which is also referred to as a support blade and is ground between a grinding wheel and a regulating wheel, each being in engagement with this tool. Since the grinding wheel and the regulating wheel rotate in opposite directions, the grinding wheel, which usually has a larger diameter than the regulating wheel, can grind the workpiece accordingly. Such stable centerless grinding machines are known such as the machine of the JUPITER series from the present applicant, for example.

US 2002/115391A1 describes a centerless grinding method in which continuous grinding and plunge cut grinding are combined with one another in one clamping, i.e., they are performed sequentially. The grinding disk used for this has a cylindrical zone and a conical zone and the same grinding cover.

To achieve different grinding goals—on the one hand, the greatest possible removal rate to reduce the cycle time and, on the other hand, a good surface quality—there is a known grinding tool comprised of grinding disks, which are aligned in rows side by side and are braced axially with respect to one another, as described in G 89 04 986.1, for example. This grinding tool is combined into a grinding disk package in which the grinding cover is designed differently from one disk to the next by using different grain sizes of one and the same grinding medium.

DE 295 16 264 U1 and DE 195 33 836 B4 describe a grinding wheel having—within the grinding layer—different physical properties in the axial direction and thus are adapted to the different grinding. This is achieved by the fact that the concentration of grains in the axial direction is variable, preferably being variable linearly. Thus, the wear behavior of the grinding layer is to be adapted to the allowance of the workpiece that is to be ground off.

DE 38 11 584 A1 describes a grinding wheel for deep grinding, wherein different tasks are assigned to different surface sections of the grinding wheel. Thus, with this known grinding wheel, parts of the grinding surface are designed differently, taking into account the different loads, namely with regard to the used diamond grain sizes in these sections as well as their concentration. Thus the main material removal should be performed by the part of the grinding surface of the grinding wheel that first engages in the forward direction. This should be implemented with one zone of a coarse diamond grain size and a downstream zone with fine diamond grain size.

DE 24 62 847 C2 describes a method for honing and a honing machine for carrying out the method, in which boreholes in particular are to be created by means of a tool having a conical grinding zone and a cylindrical grinding zone. This tool cuts with a high efficiency in the conical zone and creates the desired surface in the cylindrical zone, which is set for the finished dimension. The grinding layer is of a coarser quality in the area of the conical zone to achieve a greater removal performance than in the cylindrical zone.

It is thus known from the prior art described above that the concentration and size of the abrasive grains are to be varied within a single grinding wheel in accordance with the grinding requirements in order to perform different grinding tasks with a grinding wheel. In addition, it is known from this prior art that grinding wheel having a conical section may be used to achieve high removal rates and a cylindrical section to achieve the corresponding surface quality.

GENERAL DESCRIPTION

Accordingly, the object of the present invention is to provide a method and a grinding tool for implementing the method for high-precision centerless grinding of shaft parts, in particular piston pins, shock absorber parts and piston rods for hydraulic or pneumatic cylinders, by means of which short cycle times and low machine costs can be achieved and re-chucking operations that have a negative influence on precision can be avoided.

According to the invention, a grinding tool for high-precision centerless grinding of shaft-like workpieces is made available. In particular for shaft-like workpieces such as piston pins, shock absorber parts or piston rods for hydraulic or pneumatic cylinders, the highest demands are made of accuracy of shape and surface quality. This grinding tool according to the invention has two grinding zones with respect to its axis of rotation, one conical grinding zone and one cylindrical grinding zone, the latter being connected axially to the conical grinding zone. The conical grinding zone is designed such that it is provided for grinding at a high removal rate, which is implemented with a first grinding layer. The cylindrical grinding zone is designed such that it is provided for grinding a high surface quality of the workpiece and comprises a second grinding layer. According to the invention, the first and second grinding layers differ at least with regard to their respective grinding materials. The binding and the layer specifications of the respective grinding layer of the first and second grinding layers are preferably also different. The grinding materials, the binding and the layer specifications as well as optionally also other physical or chemical properties of the first and second grinding layers may preferably also be different. It is particularly preferred if CBN is used as the grinding material for the first grinding layer and if diamond is used as the grinding material for the second grinding layer. Different grinding materials should be understood to be those which have different grinding properties because of their different chemical compositions.

The grinding tool with its conical and cylindrical grinding zones is provided so that the workpiece is moved past a stationary grinding tool. A shaft-like workpiece is ground in a continuous process using the grinding tool according to the invention. This means that finish grinding of a workpiece is achieved in a single pass through the path of movement, which corresponds to the width of the grinding tool. In this context, finish-grinding means that the shaft-like workpiece is completed with the highest precision with regard to dimensional accuracy, shape stability and surface quality.

The preferred embodiment of the second grinding layer using diamond as the grinding material surprisingly yields the effect of extremely precise surface quality, namely on a shaft-like workpiece, even usually made of normal steel. According to the knowledge of the average person skilled in the art, diamond is not suitable as the grinding material for grinding normal steel. This is because steel has a high affinity for carbon. Since diamond consists of pure carbon, it is not suitable for machining steel. Due to the high temperatures in the grinding process, steel extracts carbon atoms from diamond. The diamond grinding grain is therefore decomposed. Therefore, the wear on such a grinding wheel or such a grinding layer would be unjustifiably high. Nevertheless, it has now surprisingly been found that with the preferred combination of CBN for the conical grinding zone and diamond for the cylindrical grinding zone, the best grinding results are achieved with respect to dimensional accuracy, shape stability and surface quality.

When grinding is performed in a continuous process and/or in centerless grinding using the tool according to the invention, the grinding tool is then preferably constructed of at least two partial grinding disks, the first partial grinding disk of which forms the conical grinding zone and the second partial grinding disk forms the cylindrical grinding zone, wherein the two partial grinding disks are preferably braced with respect to one another, so that they are adjacent to one another without forming a grinding gap, i.e., gapless. "Gapless" in the context of this invention should be understood to mean that they are almost perfectly adjacent. In the case of the aforementioned two partial grinding disks, they are braced with their basic bodies on the grinding spindle, so that their basic bodies are in contact but the grinding layers in the braced state of the partial grinding disks have a slight distance of approximately 0.2 to 0.3 mm from one another, for example. This is necessary so that no lateral stresses are introduced into the grinding layers in the braced state.

An important advantage of such a grinding tool according to the invention is that reduced cycle times and thus substantial cost savings and an overall improvement in economic outcome are associated with production of the shaft-like workpiece with the highest precision. This is important in particular in the case of workpieces to be manufactured in large quantities by using the grinding tool according to the invention.

The conical grinding zone of the grinding tool is designed for high cutting output, while the second cylindrical grinding zone is preferably designed so that either only a very minor grinding abrasion or no mentionable grinding abrasion at all is implemented using this tool, but instead only superfinish-grinding or even only surface smoothing by polishing in the sense of a so-called spark-out process is achieved.

The grinding tool is preferably designed as a grinding disk package, with which the individual partial grinding disks that constitute the grinding tool are braced with one another or against each another, respectively, and with which the conical grinding zone is formed by at least two first partial grinding disks. The advantage that the conical grinding zone is formed by at least two first partial grinding disks consists of the fact that, on the one hand, both first partial grinding disks can preferably form a cone angle differing from one another, and, on the other hand, can be manufactured and mounted better. Therefore it is also possible in an advantageous manner to perform the high material abrasion in a stepped process so to speak, so that a greater material removal is achieved with the first partial grinding disk, which at first engages with the workpiece to be ground in the grinding process, whereas the subsequent additional first partial grinding disk having a smaller cone angle yields a lower material removal than the partial grinding disk, which comes into engagement first, so that lower grinding forces are introduced into the workpiece in the conical grinding zone having the lower cone angle before grinding by the cylindrical zone, and thus a better transition into the cylindrical second grinding zone of the grinding tool is ensured.

It is also possible to design the grinding tool in one piece, so that the first and second grinding layers are arranged on its basic body in such a way axially side by side that there is no gap but instead the two grinding layers are directly adjacent to one another without any gap and without forming a step.

According to a second aspect of the invention, a method for high-precision centerless grinding for a shaft-like workpiece is described, in particular for piston pins, shock absorber parts or piston rods for hydraulic or pneumatic cylinders. According to the invention, the workpiece to be ground to high-precision is ground in a single pass and in a single chucking using a single grinding tool having a conical grinding zone with one grinding layer and with a first grinding material and a cylindrical grinding zone connected thereto axially and having a grinding layer with a second grinding material, so that the allowance and surface quality of the workpiece are ground at least partially simultaneously in a single pass and thus on a single machine. The advantage consists of the fact that, in comparison with manufacturing methods known in the prior art, which always required two machines, the method according to the invention is associated with a substantial reduction in the investment expense and thus the cost of production, in addition to saving on space, which is important in particular in producing high-precision shaft-like workpieces in large quantities.

The first grinding material is preferably CBN, which grinds the allowance with a high material removal per unit of time, and the second grinding material is diamond, which is used so that a very small but definitely much lower material removal is ground than when using the CBN grinding zone. The diamond grinding zone for achieving an extremely high-precision surface quality can also preferably be used so that the material removal to be ground in this way in the manner of superfinishing is very small or even approaches zero in the sense of a spark-out, so that only smoothing and polishing are performed. In the context of this invention, superfinishing should be understood to refer to extremely fine grinding.

BRIEF DESCRIPTION OF THE DRAWINGS

Additional advantages, embodiments and possible applications of the present invention are explained in detail below on the basis of the drawings, which show.

DETAILED DESCRIPTION OF THE DRAWINGS

Figure 1:
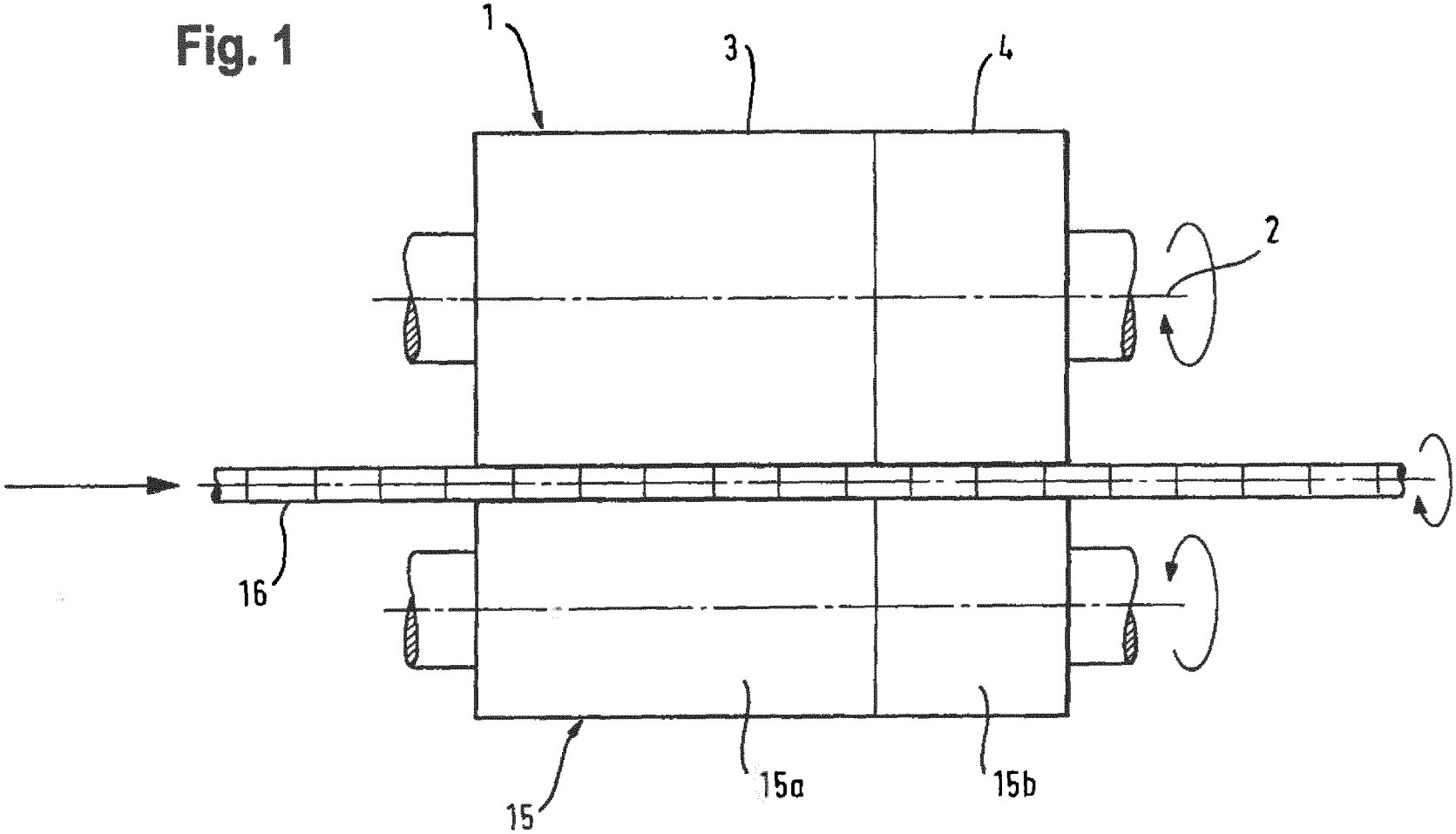
FIG. 1: the basic arrangement of the grinding wheel, the regulating wheel and the shaft-like workpiece to be ground for the centerless grinding according to the invention.

FIG. 1 shows the basic design of a grinding machine for a continuous centerless grinding using a grinding tool 1 according to the invention. The workpiece 16 rests on a support blade and is conveyed through the grinding gap between the grinding tool 1 and the regulating wheel 15 during grinding. The grinding tool 1—like the regulating wheel—has two grinding zones 3, 4 and rotates about their axis of rotation 2. The grinding tool 1 and the regulating wheel 15 rotate in opposite directions, conveying the workpiece 16 through the grinding gap between the grinding tool and the regulating wheel 15 according to the arrow shown in the continuous process during grinding. As shown in FIG. 1, the workpiece 16 is also set in rotation by the engagement of the grinding tool 1 and the regulating wheel 15.

The respective grinding zones 3 of the grinding tool 1 and 15*a* of the regulating wheel 15 are dressed conically, and the grinding zone 4 of the grinding tool 1 and the grinding zone 15*b* of the regulating wheel 15 are dressed to be cylindrical or almost cylindrical. The regulating wheel 15 is preferably designed as a one-piece regulating wheel (corundum grinding wheel with rubber binding). Its shape can be dressed, preferably using a diamond cloth.

Figure 2:
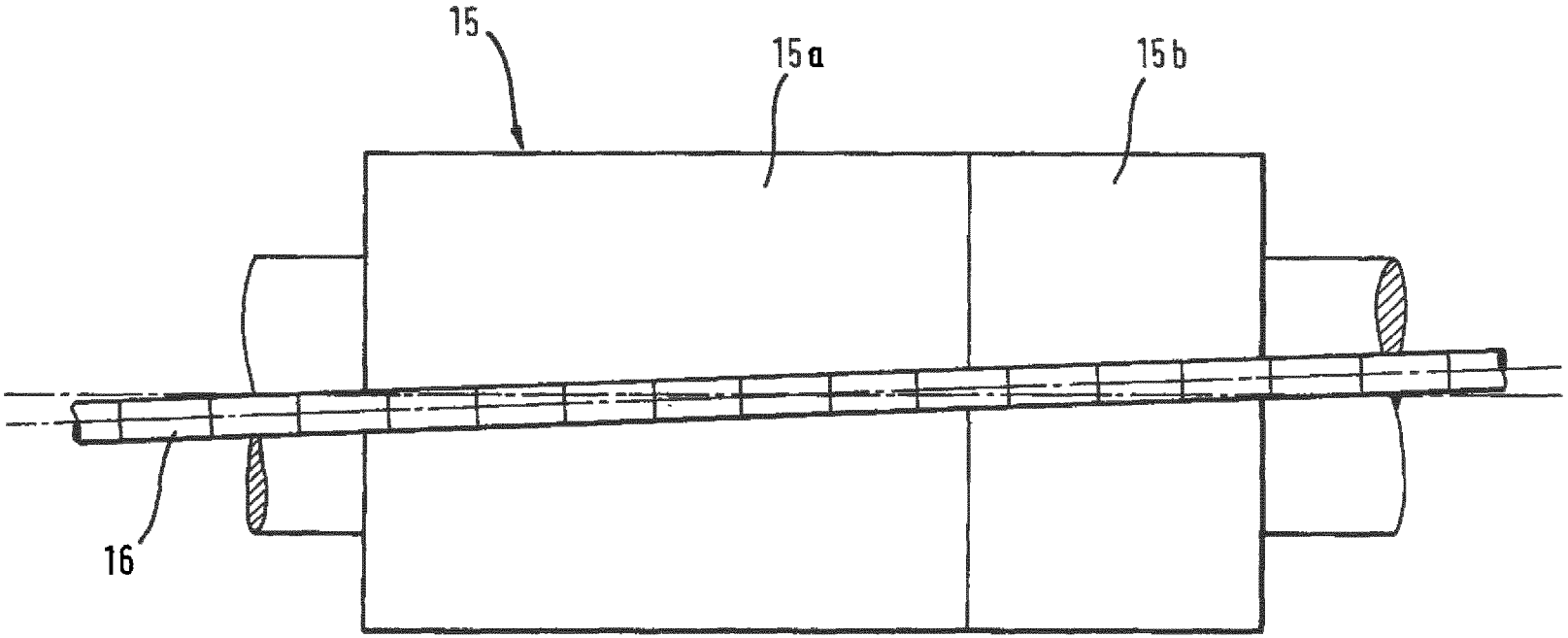
FIG. 2: the arrangement of a regulating wheel with an inclined axis to achieve a forward movement for the shaft-like workpiece in centerless grinding using a grinding tool according to the invention.

FIG. 2 shows a view of a regulating wheel 15 from the direction of the grinding tool 1 (not shown) with the regulating wheel 15 pivoted inward for grinding in a continuous centerless grinding process. Otherwise, the basic design corresponds to the one described in conjunction with FIG. 1. The inclination of the regulating wheel 15 causes the workpiece 16 to be conveyed through the grinding gap (not shown) between the grinding tool 1 and the regulating wheel 15.

Figure 3A:
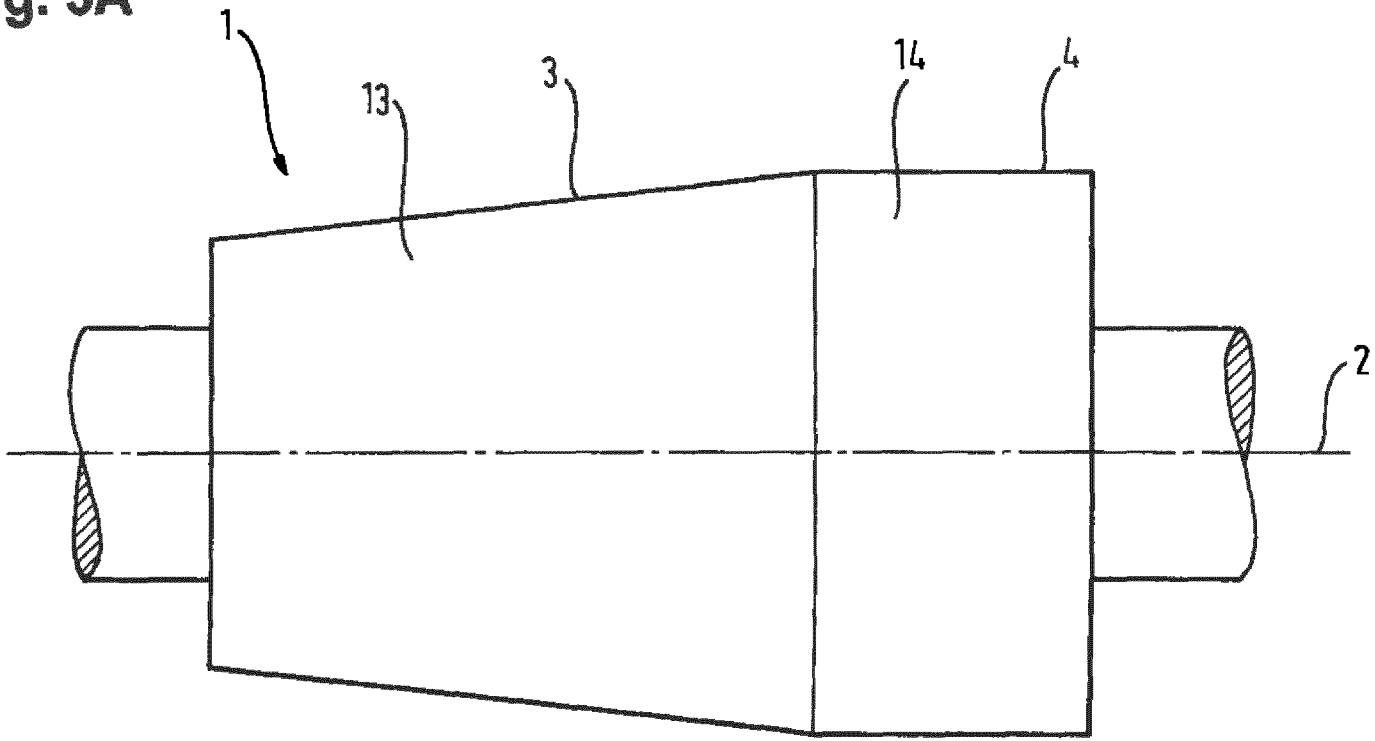
FIG. 3A: a grinding wheel with a conical grinding zone and a cylindrical grinding zone for centerless grinding in a continuous process according to the invention.

FIG. 3A shows the basic grinding wheel contour, illustrated with an exaggerated cone angle, with the grinding wheel zone 3 having a contour dressed to be conical (grinding layer 13) and the grinding wheel zone 4 with the contour dressed to be cylindrical (grinding layer 14).

Figure 3B:
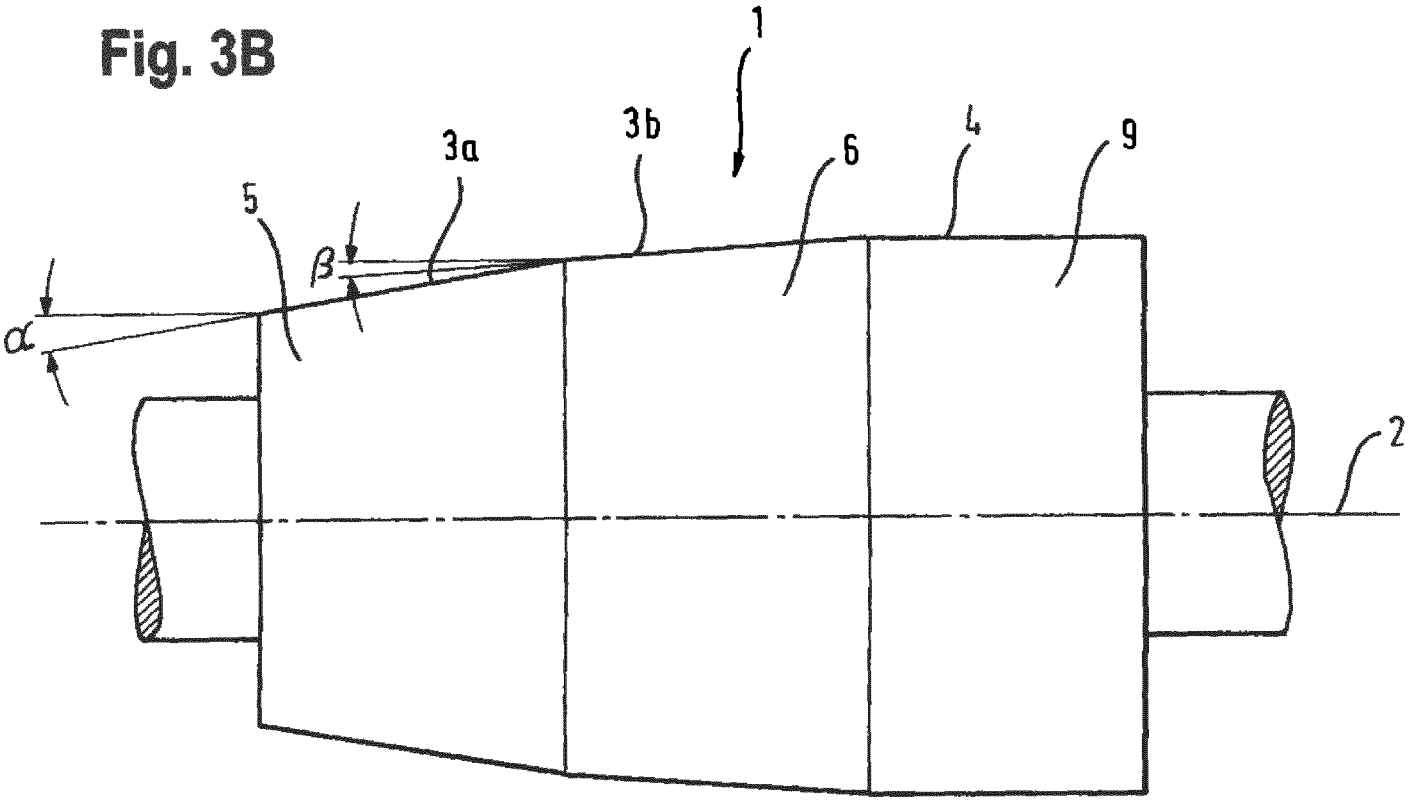
FIG. 3B: a grinding wheel according to FIG. 3A, but with two conical grinding zones of different cone angles according to the invention.

FIG. 3B shows a grinding tool 1 as a grinding disk package which is made up of three partial grinding disks 5, 6, 9. The cone angles $\alpha$, $\beta$ of the partial grinding disks 5, 6 are shown in an exaggerated representation. The grinding tool 1, which is designed as a grinding disk package, has two grinding zones 3*a*, 3*b*, which are dressed to be conical and each of which has a different cone angle a or R. The conical contour with the grinding zones 3*a*, 3*b* forms the grinding disk intake, and the cylindrical contour having the grinding zone 4 forms the part of the grinding tool 1 by means of which the surface quality of the shaft-like workpiece is achieved. The width of the respective partial grinding disks 5, 6, 9 can be selected differently, depending on the intended purpose. For the individual partial grinding disks 5, 6 the grain size may also vary to achieve an optimal adaptation to the respective grinding jobs. The grain size concentration in the grinding layer of the respective partial grinding disks 5, 6 may also vary, preferably increasing or decreasing linearly in the axial direction. The cone angles $\alpha$ and $\beta$ may also be varied depending on the allowance and thus the material removal to be ground, as a function of the material properties, for example. Regardless of whether the grinding tool 1 consists of a single basic carrier or a plurality of individual partial grinding disks to form a grinding disk package, the respective widths of the grinding zones 3*a*, 3*b*, 4 can be adapted to the technological requirements by dressing the grinding tool 1. In the present embodiment, a is larger than R, so that during grinding, the first partial grinding disk 5 of the two first partial grinding disks 5, 6 removes a larger material volume than the second partial grinding disk 6 of the two first partial grinding disks 5, 6.

Figure 4:
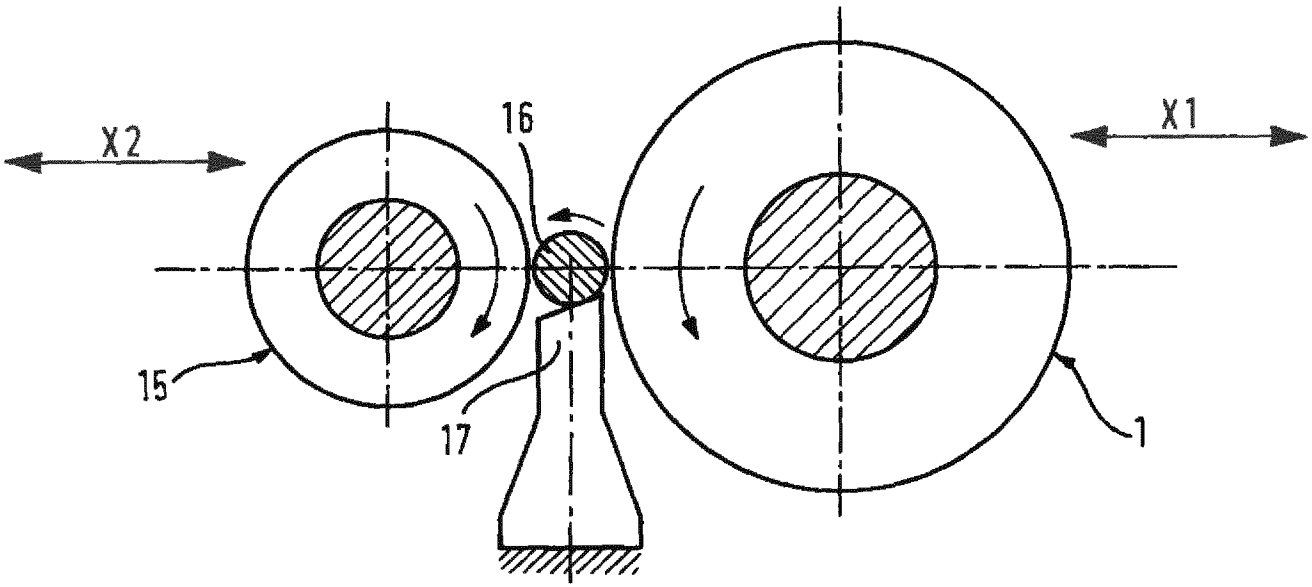
FIG. 4: a basic diagram of a centerless grinding arrangement in a side view according to the prior art.

FIG. 4 shows a basic diagram of a continuous centerless grinding in a side view of such a grinding machine. A grinding gap is defined between the grinding wheel 1 and the regulating wheel 15. During grinding, the workpiece 16 to be ground is supported in this grinding gap on a guide or support blade 17. X1 and X2 show the feed directions for the grinding spindle X1 and the regulating spindle X2. This basic design is known and is used in this form for continuous centerless grinding machines.

Figure 5:
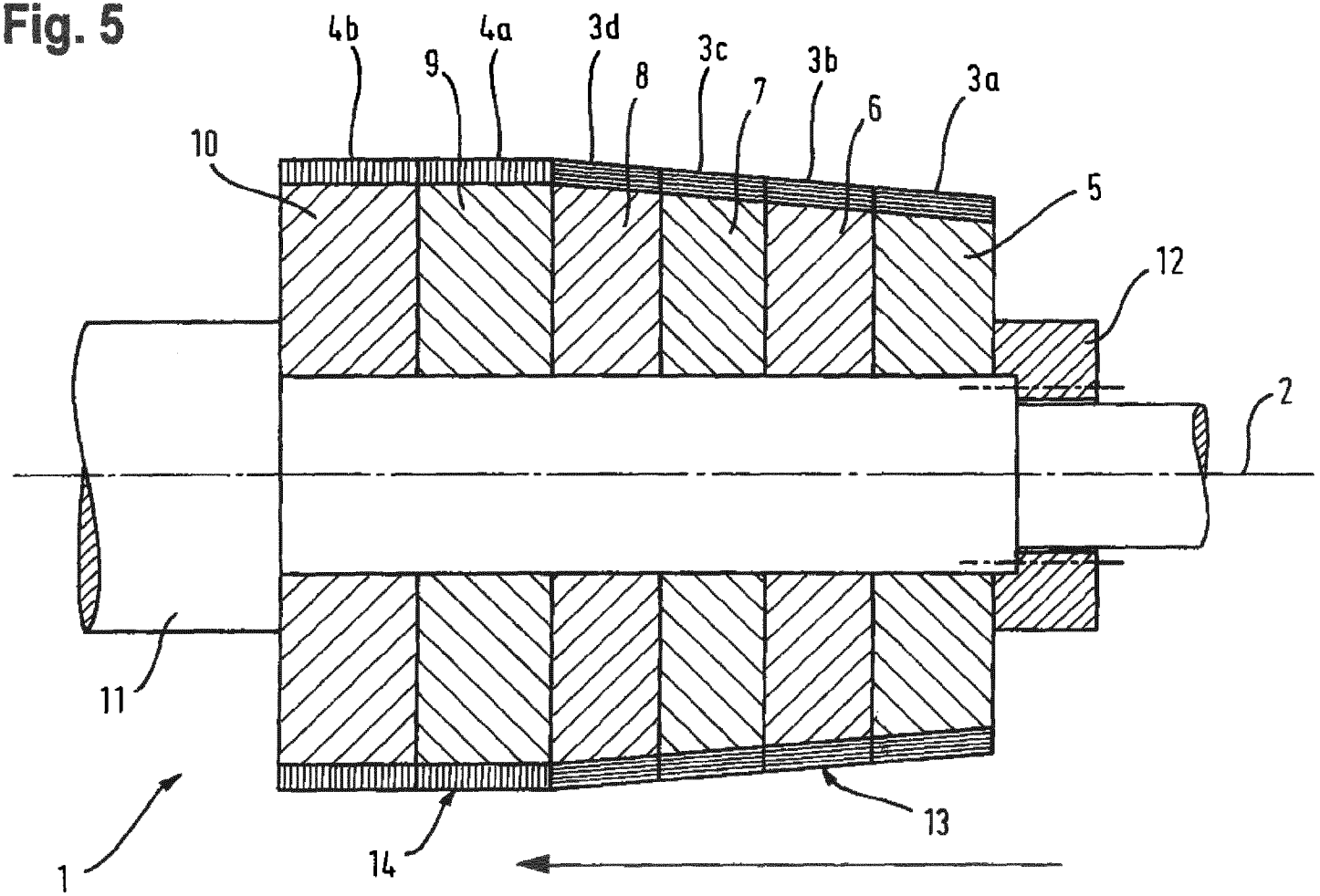
FIG. 5: a grinding tool according to the invention for carrying out a grinding method according to the invention.

FIG. 5 shows a grinding tool 1 according to the invention. This grinding tool 1 has an intake zone, which is dressed to be conical and is formed by four individual partial grinding disks 5, 6, 7, 8 in the present embodiment. Accordingly, the conical grinding zone consists of four grinding zones 3*a*, 3*b*, 3*c*, 3*d* and forms the intake zone for the workpiece (not shown here), all four partial grinding disks 5, 6, 7, 8 having the same cone angle. The four partial grinding disks 5, 6, 7, 8 all have the same grinding layer 13, which has ceramic-bound CBN as the grinding material. Using these partial grinding disks 5, 6, 7, 8, essentially the grinding allowance on the workpiece to be ground is ground off at a relatively high material removal with its conical intake contour.

The specification for the grinding layer on the respective partial grinding disk can be selected differently, depending on which amount of the allowance is to be ground off by the respective partial grinding disk. The specifications for the respective grinding layer, such as its grain size, concentration, concentration distribution, binding, etc., as well as the respective cone angle may be different, depending on the material properties and dimensions of the workpieces to be ground. With different cone angles of the partial grinding disks, the first one or more partial grinding disks generally have a larger cone angle than the following partial grinding disks. The smaller the cone angle of a partial grinding disk, the smaller is the material removal to be ground by this partial grinding disk. Thus, it is possible with the grinding tool according to the invention to optimally adjust the grinding wheel specifications to the result to be ground. In particular, the first two partial grinding disks, for example, can preferably be designed for very high material removal rate, while the two following partial grinding disks with a smaller cone angle can be designed for a lower material removal rate accordingly, though for a better dimensional accuracy and better surface quality. The variation in the material removal rate can be intentionally graduated or implemented essentially as a continuous variation from partial grinding disk to partial grinding disk, depending on the number and design of the partial grinding disks. The difference in diameter of the partial grinding disks that have been dressed to be conical comprise at least the grinding allowance of the workpiece, which is based on the diameter. The conicity of the partial grinding disks can be dressed by using a diamond wheel and can be altered easily, depending on the specific application, by means of a dressing program stored in a grinding machine equipped with the grinding tool according to the invention in a CNC-controlled process. Instead of ceramic-bound CBN, a grinding material using a synthetic resin binding may be provided as the grinding material for the partial grinding disks having a conical contour.

The partial grinding disks 9, 10 shown in FIG. 5 have a cylindrical shape. They are dressed into such a cylindrical shape and therefore have a constant or almost constant diameter.

By means of these partial grinding disks 9, 10 the surface on the shaft-like workpiece, which is not shown in FIG. 5 for the sake of simplicity, is finished to a superfine finish, i.e., is subjected to superfinishing, namely with the two grinding zones 4*a*, 4*b*. The desired high surface quality is achieved due to this superfine grinding. The grain size or the concentration of diamond grains can be designed to vary as a function of the respective grinding task even in the grinding zones 4*a*, 4*b*, e.g., increasing or decreasing in a linear fashion in the axial direction.

In the present embodiment, the partial grinding disks 9, 10 are diamond grinding disks having a ceramic binding or a synthetic resin binding. For example, due to the structure described in FIG. 5, it is possible to dress the entire grinding disk package, for example. Due to the integration of the partial grinding disks 9, 10, which carry out the superfinishing and/or superfine grinding, into the grinding tool 1, mainly accounting to for the removal of material of the allowance on the workpiece due to the partial grinding disks 5, 6, 7, 8, it is possible to eliminate the complete process of superfinishing on another machine or another station of a machine. Thus, not only short cycle times but also substantial cost savings are achieved with the grinding tool according to the invention.

The arrow shown at the bottom of FIG. 5 indicates the direction of conveyance of the workpiece in relation to the grinding tool 1. With respect to this direction of conveyance, CBN partial grinding disks, which cut mainly the material of the allowance of the workpiece, as already mentioned, are placed upstream of the diamond partial grinding disks 9, 10 and the dimensional accuracy and shape stability are established at least roughly. Accordingly, the diamond partial grinding disks 9, 10 are accordingly responsible "for the last grinding," so to speak, with respect to the dimensional accuracy and shape stability, as well as for the production of the required high surface quality.

A high-precision dimensional accuracy and shape stability as well as surface quality can be achieved for centerless grinding in the continuous process, since the grinding tool 1 according to the invention combines a plurality of grinding disks having different physical properties by means of a clamping flange 12 in a grinding disk package on the grinding spindle 11 that rotates with the axis of rotation 2. Such a grinding tool in the form of a compact grinding wheel having a large width for removal of a larger material volume and at the same time achieving a high surface quality offers the possibility of applications in mass production with extremely high quality demands.

The invention claimed is:

1. A grinding tool (1) for high-precision centerless grinding of a shaft-like workpiece in a continuous process, having a conical grinding zone (3) with respect to its axis of rotation (2) and a cylindrical grinding zone (4) connected to the latter, wherein the conical grinding zone (3) is designed for grinding at a high removal rate with a first grinding layer (13), and the cylindrical grinding zone (4) is designed for grinding a high surface quality with a second grinding layer (14), and the first grinding layer (13) and the second grinding layer (14) are different at least with regard to their grinding materials.

2. The grinding tool (1) according to claim 1, in which the first grinding layer (13) and the second grinding layer (14) are different with respect to the binding and the grinding layer specifications.

3. The grinding tool (1) according to claim 1, in which, as the grinding material, the first grinding layer (13) uses CBN, and the second grinding layer (14) uses diamond.

4. The grinding tool (1) according to claim 1, which is constructed of at least two partial grinding disks (5 through 10), the first partial grinding disk (5 through 8) thereof forming the conical grinding zone (13) and the second partial grinding disk (9, 10) thereof forming the cylindrical grinding zone (14), wherein both partial grinding disks (5 through 10) are adjacent to one another without a gap.

5. The grinding tool (1) according to claim 1, constructed of a grinding disk package, in which the conical grinding zone (13) is formed by at least two first partial grinding disks (5, 6; 7, 8).

6. The grinding tool (1) according to claim 5, in which the two first partial grinding disks (5, 6; 7, 8) have different cone angles.

7. The grinding tool (1) according to claim 1, which is designed integrally and the first grinding layer (13) and the second grinding layer (14) are arranged axially side by side without a gap.

8. The grinding tool (1) according to claim 1, in which the first grinding layer (13) and the second grinding layer (14) are arranged on an integrally designed basic body.

9. A method for high-precision centerless grinding of a shaft-like workpiece in a continuous process, in particular piston pins or shock absorber parts, wherein the allowance and surface quality of the workpiece are ground simultaneously at least temporarily by means of a conical grinding zone using a first grinding material and by means of a cylindrical grinding zone connected axially thereto and using a second grinding material of a single grinding tool, the single grinding tool (1) having a conical grinding zone (3) with respect to its axis of rotation (2) and a cylindrical grinding zone (4) connected to the latter, wherein the conical grinding zone (3) is designed for grinding at a high removal rate with a first grinding cover (13), and the cylindrical grinding zone (4) is designed for grinding a high surface quality with a second grinding cover (14), and the first grinding cover (13) and the second grinding cover (14) are different at least with regard to their grinding agents.

10. The method according to claim 9, wherein grinding is performed using CBN as the first grinding material and diamond as the second grinding material.

11. The method according to claim 9, wherein the CBN grinding zone grinds the allowance in a first high material removal volume per unit of time, essentially to the final dimension, and the diamond grinding zone grinds the surface quality at a second material removal volume, which is less than the first material removal volume or almost approaches zero.

* * * * *